US005213494A

United States Patent [19]

Jeppesen

[11] Patent Number: 5,213,494

[45] Date of Patent: May 25, 1993

[54] PORTABLE BURNER FOR FUEL GAS WITH TWO MIXER TUBES

[75] Inventor: Palle L. Jeppesen, Sonderho, Denmark

[73] Assignee: Rothenberger Werkzeuge-Maschinen GMBH, Kelkheim/Ts, Fed. Rep. of Germany

[21] Appl. No.: 812,153

[22] Filed: Dec. 23, 1991

[30] Foreign Application Priority Data

Jan. 11, 1991 [DE] Fed. Rep. of Germany ..... 4100657

[51] Int. Cl.[5] ..... F23D 11/36

[52] U.S. Cl. ..... 431/343; 126/271.2 R; 126/271.2 A; 431/354; 431/352

[58] Field of Search ..... 431/343, 201, 175, 252, 431/352, 351, 353, 185, 173, 354; 126/271.1, 271.2 R, 271.2 A, 271.2 C

[56] References Cited

U.S. PATENT DOCUMENTS

| | | | |
|---|---|---|---|
| Re. 28,665 | 12/1975 | Zagoroff . | |
| 1,957,144 | 5/1934 | Littleford, Jr. | 126/271.2 A |
| 2,864,360 | 12/1958 | Love | 126/271.2 R |
| 3,311,104 | 3/1967 | Wollner et al. | 126/271.2 A X |
| 3,779,694 | 12/1973 | Zagoroff . | |
| 3,917,442 | 11/1975 | Zagoroff . | |
| 4,013,395 | 3/1977 | Wormser . | |
| 4,025,292 | 5/1977 | Bailey et al. | 431/354 X |
| 4,179,262 | 12/1979 | Wardt et al. . | |

FOREIGN PATENT DOCUMENTS

| | | |
|---|---|---|
| 0240751 | 10/1987 | European Pat. Off. . |
| 2254891 | 5/1973 | Fed. Rep. of Germany . |
| 2645263 | 4/1978 | Fed. Rep. of Germany . |
| 212284 | 2/1941 | Switzerland . |
| 304938 | 1/1929 | United Kingdom . |

*Primary Examiner*—Larry Jones
*Attorney, Agent, or Firm*—Felfe & Lynch

[57] ABSTRACT

A portable burner (1) has a first (6) and a second mixer tube (18) for the delivery of primary and secondary air. To the first mixer tube belong an injector nozzle (2) for fuel gas and a spin producer (10). This first mixer tube (6) leads concentrically into the second mixer tube (18) larger in diameter, which has an inlet end (19) for the burner flame and aspiration points (20) for the secondary air. For the achievement of a thorough mixing of hot and cold gases and a low mixing temperature, between the outlet end (13) of the first mixer tube (6) and the inlet end (19) of the second mixer tube (18) there is disposed a filler body (16) filling the radial distance between the two tube ends and having a radial end face (21) from which the outlet end (13) of the first mixer tube (6) protrudes by a given amount "s." The aspiration points (20) for the secondary air are disposed exclusively in the area of the outlet end (13) of the first mixer tube (6) and aimed radially at the nozzle axis (A—A). As a result the secondary air impinges vertically on the initial length of the burner flame. Furthermore the second mixer tube (18) has between the second aspiration points (20) and its outlet end (23) a closed circumferential portion (18*a*) whose length is at least three times the axial length of the second aspiration points (20).

17 Claims, 3 Drawing Sheets

PORTABLE BURNER FOR FUEL GAS WITH TWO MIXER TUBES

BACKGROUND OF THE INVENTION

The invention relates to a portable burner with a first injector nozzle for fuel gas, which is disposed adjacent a first primary air aspiration point at the entry end of a first mixer tube, with a spin producer which is disposed in the first mixer tube at a distance in front of the outlet end thereof forming a second nozzle with a nozzle axis, and with a second mixer tube whose internal cross section (F2) is greater than the internal cross section (F1) of the first mixer tube and is disposed concentrically with the outlet end of the first mixer tube directly producing a burner flame, has an entry end for the burner flame and second aspiration points for secondary air in the area of the outlet end of the first mixer tube, and extends in the direction of flow all the way to its outlet end.

The fuel gas is usually obtained by the evaporation of liquid gas such as propane, butane or mixtures thereof, and dispensing it under pressure control.

It is known that, when a gas stream enters into an initially quiet gaseous medium, it sets the latter in motion, entrains it to some extent and drives it in the same direction. This process, called the injector process, is based on friction, turbulence and diffusion processes. It takes place also in a free atmosphere. However, its effectiveness can be increased by causing these processes to take place under guidance in a tubular housing which is composed of nozzles, tube sections and inlet and outlet openings. Known examples are the ejector or jet pump, including the diffusion pump, and the gas burner, including the Bunsen burner that is so familiar in school instruction.

The initial impulse of the gas stream produced as a rule by a nozzle (conversion of pressure to velocity) is distributed to the entrained gas. If sufficient guidance is not provided the gas stream rapidly becomes increasingly larger in cross section and slower, until the energy is used up by friction and/or, after deduction of losses, has been reconverted to pressure.

Nevertheless, a gas stream into initially quiet air has a very appreciable reach, which can be seen in examples from daily living. A candle can be made to flicker, if not go out, by blowing with the breath even from a distance of two meters. At the take-off of a jet aircraft the backwash reaches kilometers into the landscape, so that successive take-offs have to be delayed until the atmosphere quiets down.

Media of different densities and/or temperatures are especially difficult to mix. A "temperature layering" takes place over long distances.

German Patent Disclosure Document 2,254,891 discloses gas burners of the kind described in the beginning, which are designed for shrinking or for welding plastic films and which consequently have to produce hot gas at low outlet temperatures In the published embodiments the second mixer tube is either A made in its entire length without openings, or B the openings extend all the way to the outlet end or, in any case, into the direct vicinity of the outlet end of the second mixer tube. The secondary air consequently flows substantially in an axial direction, which is to be further explained below.

In case A the second mixer tube is widened at the inlet end and forms with the adjacent walls of the combustion chamber an inlet cone or a kind of spatial pipe elbow which turns the aspirated cold air in the vicinity of the wall of the mixer tube into a purely axial direction before the cold air reaches the burner flame. Temperature equalization in this case can be accomplished only by the divergence of the flame jet and marginal turbulences. Since the outlet opening of the combustion chamber, however, is oval or slot-shaped, this can take place in only one plane. Temperature layering is thus maintained at least over a considerable length of the second mixer tube, so that at the outlet opening of the second mixer tube a temperature profile is produced with a maximum in the center: the hot core of the gas stream reaches correspondingly far.

In case B too, the second mixer tube is completely open at the inlet end. Due to the uniform distribution of the perforations over the entire length, or most of the length, of the mixer tube, this has virtually no effect. The hot gas stream acts as a free stream, and this is expressly mentioned As a result, the aspiration takes place substantially in the axial direction the cold air and the hot gas stream flow substantially parallel to one another, and a far-reaching gas stream with a hot core is formed, i.e., with a temperature layering that diminishes only gradually, i.e., with increasing distance from the combustion chamber, due to stream divergence and mixing.

It is common to all burners that, due to limited dimensions, unavoidable built-in hardware such as flame holders, divided aspiration ducts etc., different air/gas fuel ratios form in the flow and in the flame, and hence also locally defined zones of different temperatures which are clearly recognizable in the flame as bright and dark streaks or "schlieren."

When spin producers are used in the known systems for the production of a twisting flow, this intensifies the temperature layering, which cannot be eliminated even by the oval or slot-shaped end of the combustion chamber. This will be further discussed herein:

Through U.S. Pat. No. 4,013,395 it is known to separate a combustion chamber from the single mixer tube by a spin producer in the form of radial vanes serving as a flame holder By means of the spin producer, the initially still cold mixture of fuel gas and ambient air is set in rapid rotation which continues in the combustion chamber about its axis. Due to the centrifugal forces caused thereby, the relatively cooler (higher-density) gas streams are thrown against the wall of the combustion chamber and cool it, while the relatively hotter (lower-density) gas streams gather in a core zone. This core zone is the actual, very hot working flame, which extends far out of the burner orifice This known burner does not have a second mixer tube. Such a burner serves preferably for the welding and hard soldering of metals.

German Patent Disclosure Document 2,254,891 and U.S. Pat. No. 4,013,495 pursue diametrically opposite courses and aims.

European Patent Disclosure Document 0,240,751 discloses a low-pressure hand burner in which a hot flame core without a spin producer is separated from the combustion chamber wall by a surrounding stream of cool ambient air. Here, too, a hot, far-reaching flame is produced, which issues from the combustion chamber. The surrounding stream that cools the combustion chamber wall is produced by the aspiration of ambient air through the back end of the burner in which openings are present which produce an air stream parallel to the combustion chamber wall and directly adjacent thereto This parallel flow is wanted, and it makes any mixing difficult.

British Patent 304,938 discloses a burner of a different kind with two injection systems arranged in series for the aspiration of primary and secondary air, which is to be fixedly screwed to a fixed line with all nozzles aligned vertically. By means of several adjusting devices and the design specifications for the ducting, it is said to bring it about that the gas-air mixture completely fills the cross section of the passage following each nozzle, and achieves such a velocity of flow at graduated stoichiometric mixture ratios that the burner flame does not strike back into the passages. According to the provisions, no flame burns in the final, cold injection tube. Instead, a far-reaching, hot flame issues from the last orifice. Spinning of the gases within the burner is even to be expressly avoided.

SUMMARY OF THE INVENTION

It is therefore the object of the invention to improve a burner of the kind described above, to the effect that it will produce a hot gas stream of relatively low temperature and with a very uniform temperature distribution , with a limited length of the second mixer tube. Especially, no visible flame is to issue from the outlet orifice of the second mixer tube, so that the burner can be used to work with heat-sensitive materials such as roofing felt, roofing films and the like, even when improperly operated The achievement of the stated object is accomplished in accordance with the present invention, in the burner described above, by the fact that a) Between the outlet end of the first mixer tube and the inlet end of the second mixer tube a filler body with an end face running substantially radially to the nozzle axis (A—A) is disposed, which at least substantially fills the radial distance between the two tube ends, and from it the outlet end of the first mixer tube protrudes by a given dimension "s," which forms the second nozzle, and that b) The second aspiration points for the secondary air are disposed exclusively at the outlet end of the first mixer tube and are aimed radially at the nozzle axis, such that the secondary air impinges substantially vertically and radially upon the initial length of the burner flame running in the direction of the nozzle axis, and that the second mixer tube has between the second aspiration points and its outlet end a closed jacket portion whose length is at least three times the axial extent of the second aspiration points.

By means of feature a) the formation of an axis-parallel flow of the secondary air is prevented or suppressed from the outset.

By means of feature b) it is accomplished that the aspirated secondary air impinges at a right angle onto the initial length of the burner flame and promotes its agitation and mixing with the secondary air at a very early moment of time. The transversely aspirated secondary air thus serves to some extent to break up any cool marginal or encasing flow which might be expected on account of the spin producer, and prevent it from reforming. The transversely entering secondary air not only retards the spin effect and centrifugal effect, which is really desired in the end of the first mixer tube, but it also retards the formation of any overly great axial velocity in the area of the jet axis. The result is a great uniformity in the diametral temperature profile at the outlet end of the second mixer tube. Since a large amount of secondary air is aspirated, the average temperature of the hot gas is comparatively low: it is between about 500° and 650° C. Above all, no flame issues from the burner, so that temperature-sensitive materials such as roofing felt and roofing films can be treated easily even by unskilled persons. The inherent safety of the burner is of quite crucial importance due to the liability requirements of a roofing company, for example.

At the same time it is important that the design of the first injector system be made such as to produce a largely stoichiometric gas mixture which permits complete combustion. The admixture of large amounts of secondary air not only serves o continue the combustion process, but also to lower the temperature while at the same time increasing the average velocity of flow, since the thermal gradient improves with the velocity of flow.

The relative shortness of the second mixer tube reduces the cost of manufacture and facilitates use. Due to the lack of any openings in the area beyond the second aspiration point, the mixing process is facilitated over the entire cross section of the second mixer tube. Neither can it happen that energy losses due to spreading of the hot gas stream and mixture with downstream air, as is the case in the state of the art with such second mixer tubes which are provided with large openings over their entire length or at least most of their length, so that a virtually free jet is formed. For this again leads to a layering of temperatures.

An especially simple burner design is achieved when the filler body is configured as a rotationally symmetrical part having an internal bore for the insertion of the first mixer tube and with at least one external surface for the placement of the second mixer tube. The filler body in this case is the only coupling between the two mixer tubes and is of simple and stable shape.

The different action of exclusively axial and radial aspiration of secondary air can be impressively demonstrated in this manner: Let the filler body be provided with axial openings for the aspiration of secondary air. If now the radial aspiration openings in the second mixer tube are closed, the flame issues from the second mixer tube in the form of a hot core. In this case the burner can also be ignited at the outlet orifice of the second mixer tube, thereby also demonstrating the inadequate gas mixing. In the case of the radial flow according to the invention this cannot be done, because quite obviously the gas mixture is below the ignition limit at all points. In this case it is necessary to ignite the burner through the radial aspiration openings.

It is furthermore especially advantageous if the outlet end of the first mixer tube, which forms the nozzle, projects by about 4 to 15 mm, preferably by 6 to 12 mm, from the end face of the filler body. A value proven practical is 9 mm. This nozzle projection permits a sufficient overlapping of the nozzle margin with the cross flow produced by the slot, as will be explained below.

The nozzle at the end of the first mixer tube is, so to speak, the injector nozzle for the second mixer tube. Its action does not absolutely depend on the fact that the nozzle is formed by a narrowing of the first mixer tube; the increasing of the gas velocity by the combustion process is already sufficient for the production of an aspirating effect. It is advantageous, however, to increase the effect of the nozzle by a constriction of flow, i.e., by bending inward the circular edge of the outlet end of the first mixer tube on its entire circumference to such an extent that the outlet diameter is smaller by 15 to 25%, preferably by 19 to 21%, than the inside diameter of the first mixer tube.

To achieve a good effect in mixing fuel gas and primary air it is especially advantageous if the ratio of the distance (d) of the end face of the spin producer from the edge of the outlet end of the first mixer tube to the inside diameter (D1) of the first mixer tube amounts to at least 1.0, preferably 1.1 to 1.5.

It has furthermore proven to be advantageous if the spin producer has vanes distributed about the axis A—A of the first mixer tube and their angle of pitch with respect to the axis A—A at the outside diameter of the spin producer is less than 40 degrees, preferably less than 35 degrees. It has been found that the angle of pitch must be made lower for given dimensions of the mixer tube as the burner output increases. Furthermore, it is advantageous for the spin producer to be decidedly beveled at the input end and for the angle of the generatrices of the bevel with respect to a radial plane to be at least largely the same as the angle of pitch of the vanes with respect to the axis A—A.

Particularly optimal burning characteristics are achieved when the ratio of the inside cross section F2 of the second mixer tube to the inside cross section F1 of the first mixer tube amounts to between 4.0 and 4.8, preferably to about 4.3.

In a preferred embodiment of the burner, the two aspiration points are in the form of axially parallel slots distributed about the circumference of the second mixer, with the end portions of the slots directed toward the filler body or nozzle overlapping at least partially the portion of the first mixer tube that protrudes from the end face of the filler body.

At the same time the proportion of all slots, as seen in the circumferential direction, on the entire circumference of the second mixer tube, is to amount to at least 50%. The top limit depends only on the strength limits of the material of the second mixer tube, since the slots naturally entail a weakening of the material.

Furthermore, the ratio of the sum of the cross-sectional areas of all slots to the inside cross section of the second mixer tube is to amount to at least 1.2, and preferably to between 1.4 and 1.5.

It is also desirable for the ratio of the length of each individual slot to the length of the second mixer tube projecting past the filler body to be between 0.10 and 0.20, preferably between 0.14 and 0.17. In this manner a sufficiently great closed length of the second mixer tube is assured.

For the simultaneous treatment of large areas it is furthermore advantageous for the burner with several similar burners to be fastened to a beam with their axes A—A parallel to one another to form a battery of burners connected to a common gas supply line running parallel to the beam.

In order then to assure burner movement at a constant distance above the surface to be treated it is desirable for the burner battery to be provided with wheels whose horizontal axes are perpendicular to the burner axes A—A.

Then, to concentrate the hot gases on the given treatment area and especially in the outdoors to reduce the disturbing influence of side wind, it is furthermore advantageous to provide baffles on both sides of the burner battery, whose vertical principal planes are parallel to the burner axes.

Additional advantageous configurations of the subject matter of the invention will be found in combinations of features from the secondary claims with one another and with those of the principal claim, and in the following detailed description.

Examples of the embodiment of the subject matter of the invention are further explained below with the aid of FIGS. 1 to 6.

DESCRIPTION OF THE PREFERRED EMBODIMENT

Figure 1:
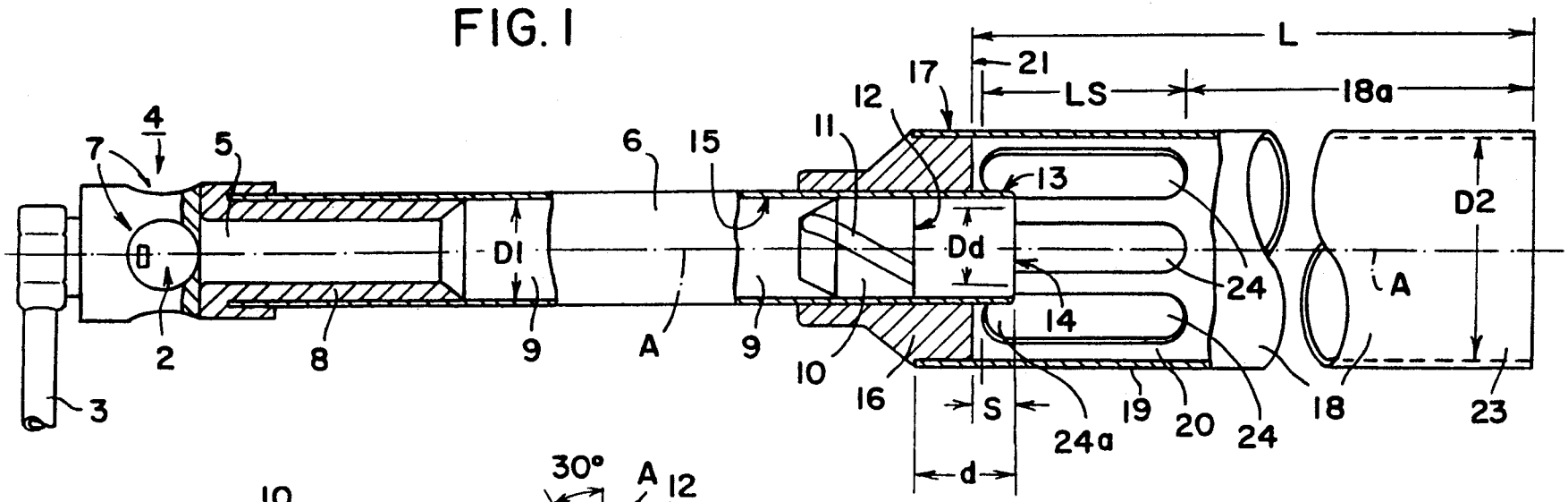
FIG. 1 shows an axial section through the burner.

In FIG. 1 there is shown a basic element of a portable burner 1 with a first injector nozzle 2 to which the fuel gas is fed through a line 3 from a liquid gas tank not shown. The injector nozzle 2 is disposed in the area of a first primary air aspiration point 4 at the inlet end 5 of a first mixer tube 6. The aspiration point 4 consists of four radial bores 7 distributed on the circumference. In the first mixer tube, directly following the bores 7, there is an insert 8 which forms a Venturi tube. The insert 8 is adjoined by a mixing length 9 which merges with a spin producer 10 which consists of a hub with radially extending vanes 11. The vanes can also be formed by sections of material between slanting bores in a cylindrical body.

The pitch angle of the vanes 11 at the outside diameter of the spin producer 10 or of the axes of the bores, as the case may be, with respect to the axis A—A amounts to 30 degrees. The spin producer 10 has an end face 12 which is disposed at a distance d of 32 mm ahead of the outlet end 13 of the first mixer tube 6 forming a second nozzle with a nozzle axis. The inside diameter D1 of the first mixer tube is 26 mm, so that the ratio of d:D1=1.23.

Figure 3:
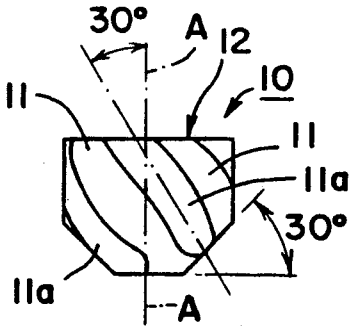
FIG. 3 is a side view perpendicular to the axis of the spin producer according to FIG. 2.
Figure 2:
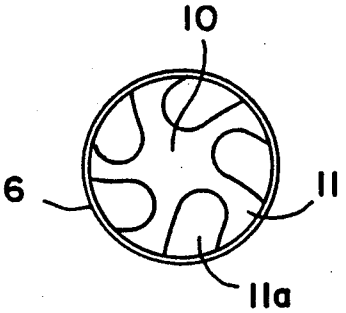
FIG. 2 is a top view taken in the axial direction of the planar end face of the spin producer within the first mixer tube, on an enlarged scale.

As more clearly seen in FIGS. 2 and 3, the spin producer 10 has five vanes 11 and five channels 11*a* between them with a pitch angle of 30 degrees. On the inlet side opposite the end face 12 the spin producer is turned with a taper to form a bevel at the same angle of 30 degrees, but with respect to a plane radial to the axis A—A. The diameter of the smallest circumferential edge at the bevel amounts approximately to the core diameter of the spin producer 10.

The circular front edge 14 at the outlet end 13 of the first mixer tube 6 is rolled inward to such an extent that the inside diameter Dd of the nozzle amounts to 21 mm, i.e., the diameter is reduced by 19.23%, the cross section by 34.76%; the discharge velocity is increased accordingly.

The first mixer tube 6 is inserted with its downstream end into an internal bore 15 of a filler body 16 which is configured as a rotationally symmetrical piece and has at least one outside surface 17 for the placement of a second mixer tube 18 thereon. This second mixer tube is likewise cylindrical, has a length L equal to 295 mm beyond the end face 21 of the filler body 16, and its inside cross section F2, at a diameter of 54 mm, is greater than the inside cross section F1 of the first mixer tube 6, namely 2,289 $mm^2$:530 $mm^2$. Hence, the ratio of the inside cross section F2 of the second mixer tube 18 to the inside cross section F1 of the first mixer tube 6 is about 4.31. The second mixer tube 18 is concentric with the outlet end 13 of the first mixer tube 6 and has an inlet end 19 for the burner flame and two aspiration points 20 for secondary air.

The radial distance between the outlet end 13 of the first mixer tube and the inlet end 19 of the second mixer tube is closed by the filler body 16. The end face 21 of the filler body extends substantially radially from the nozzle axis A—A, and the outlet end 13 of the first mixer tube 6, which forms the second nozzle, protrudes from it by a given amount s, which in the present case amounts to 9 mm.

The second secondary air aspiration points 20 are disposed only in the area of the outlet end 13 of the first mixer tube 6 and aligned radially on the nozzle axis A—A. In this manner the secondary air is directed substantially vertically against the initial length of the burner flame running in the direction of the nozzle axis.

Between the second aspiration points 20 and its outlet end 23 the second mixer tube 18 has a closed circumferential portion 18*a* whose length is 5.17 times the axial length of the second aspiration points 20. Special attention is to be given to the position and dimensions of these second aspiration points:

The second aspiration points 20 are configured as axially parallel slots 24 distributed equidistantly on the circumference of the second mixer tube 18. There are 7 slots with a width of 13 mm, which are rounded semicircularly at both ends. The length LST is 47 mm, so that an inlet cross section of 475 $mm^2$ per slot and a total cross section of 3,375 $mm^2$ are the result. The ratio of this total cross section to the internal cross section of the second mixer tube is 1.45.

The end sections 24*a* of slots 24 toward the filler body 16 overlap by about 7 to 8 mm the portion of the first mixer tube 16 protruding from the end face 21 of the filler body 16. The length of the slots also assures that the secondary air will strike a considerable part of the initial length of the flame, which is not shown, and produces its turbulence.

The width of the axially parallel lands 25 between the slots amounts to 11 mm, so that the ratio of all slots 24, seen in the circumferential direction, to the total circumference of the second mixer tube 18 is equal to 13 : (11+13) or 54.1 percent.

Figure 4:
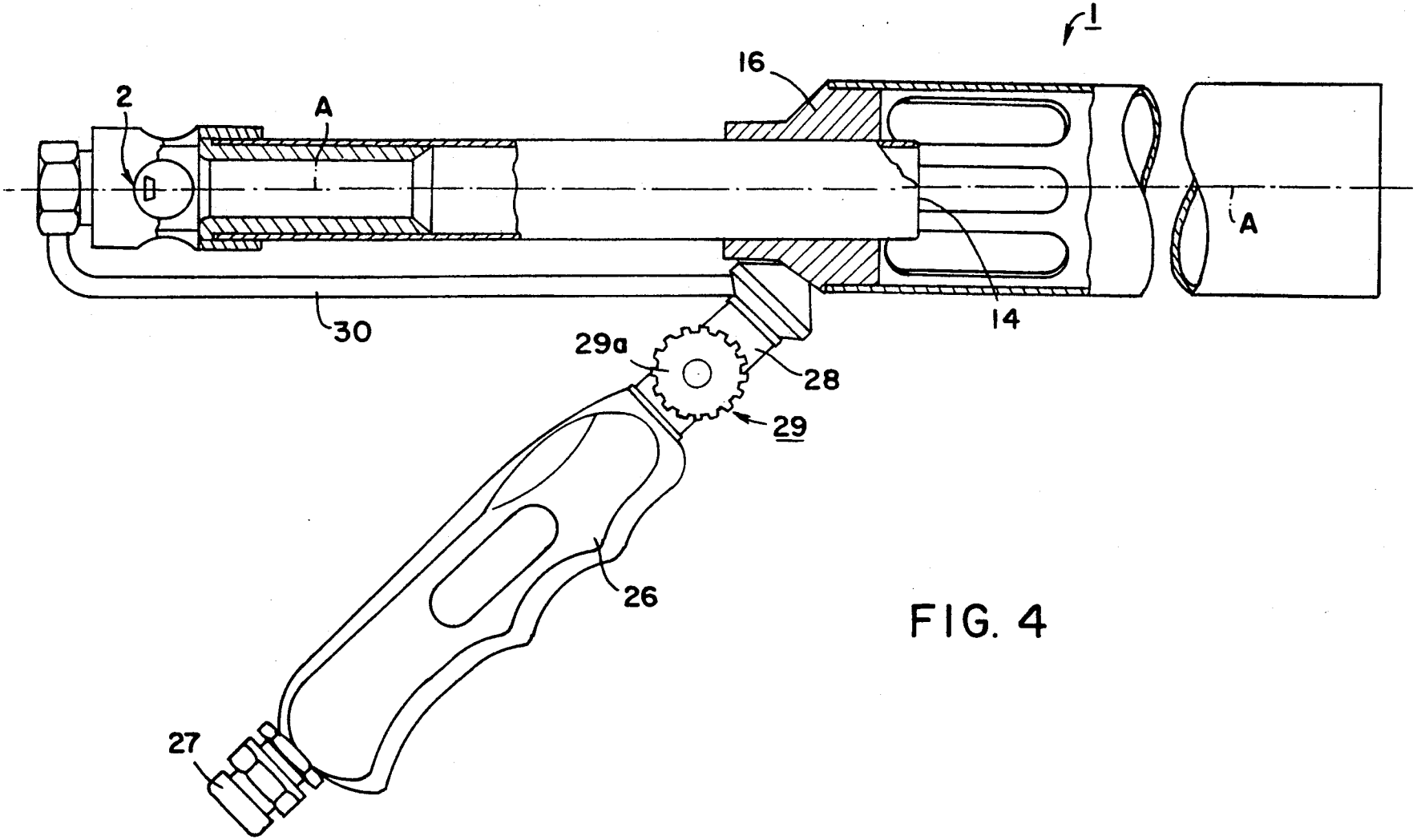
FIG. 4 shows a burner according to FIG. 1 which is configured by means of a handle as a hand torch.

FIG. 1 shows the basic unit for different stages of expansion of the burner according to the invention. FIG. 4 shows that a hand torch can be formed by attaching to the filler body 16 a handle 26 having a connecting thread 27 for a gas hose.

In a connecting piece 28 between the handle 27 and the filler body 16 there is a gas valve 29 with an adjusting knob 29*a*. Beyond the gas valve 29 the connecting piece 28 is connected with the injector nozzle 2 by a gas line 30. The hand torch can be supplemented by a piezoelectric igniter whose one ignition electrode is situated in front of the front edge 14 of the first mixer tube (not represented).

Figure 5:
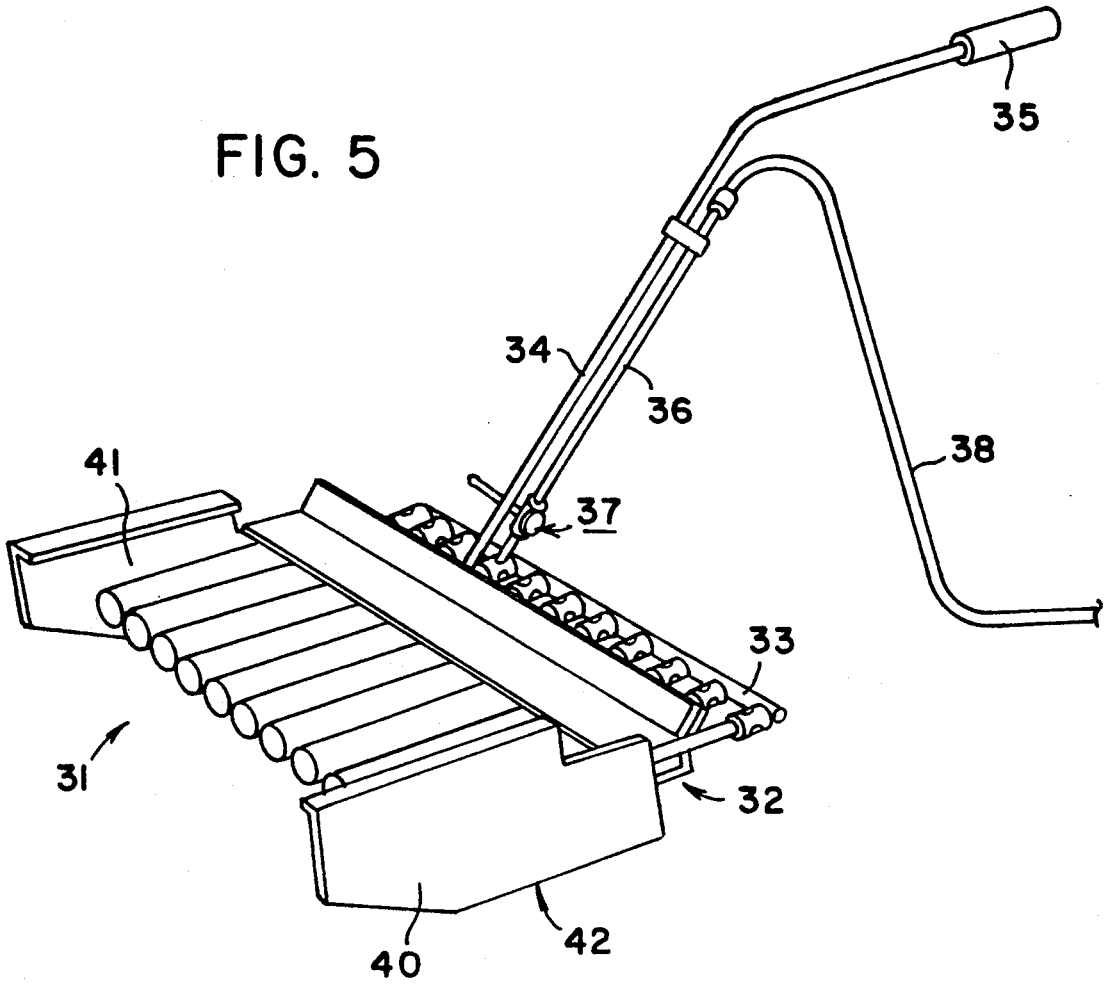
FIG. 5 shows a combination of several burners according to FIG. 1 to form a transportable burner battery in the ready-to-operate state.
Figure 6:
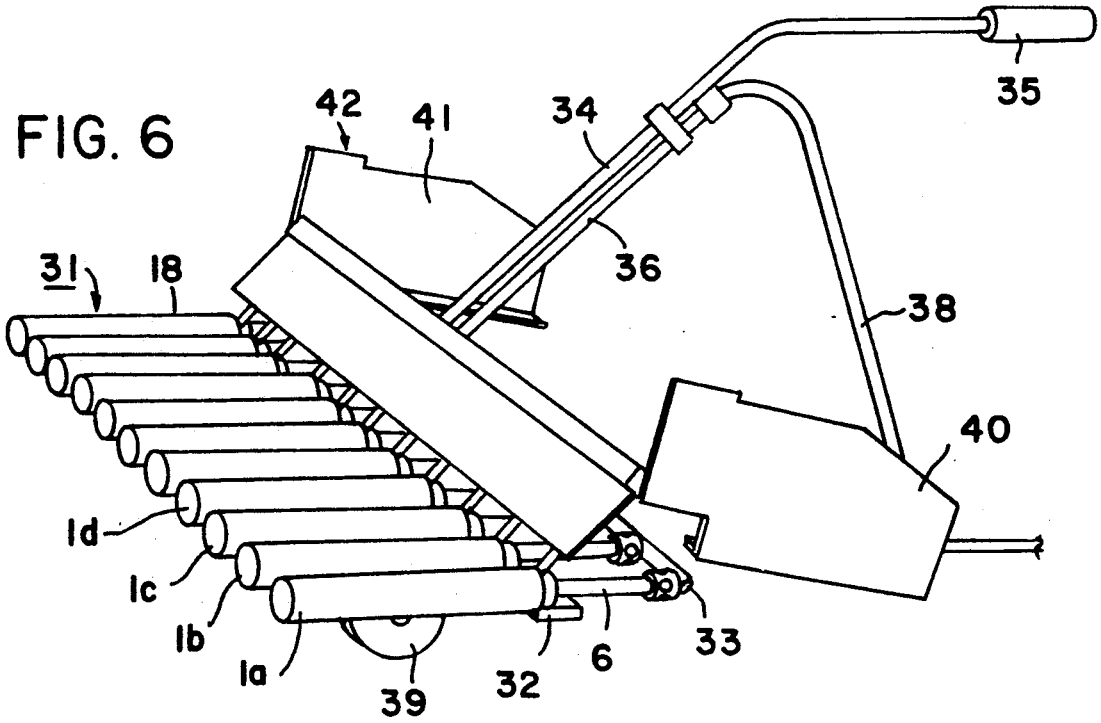
FIG. 6 shows a burner battery according to FIG. 3, with baffles swung upward and backward.

FIGS. 5 and 6 show a burner battery 31 for the simultaneous heating of large areas. The burner battery is formed by fastening one burner la according to FIG. 1 to a plurality of similar burners 1*b*, 1*c*, 1*d*, . . . with their axes A—A parallel to one another on a beam 32 and they are connected to a common gas supply line 33 running parallel to the beam.

Furthermore, a carrying handle 34 with a hand grip 35 is mounted on the beam 32, and on the handle a supply line 36 with a gas valve 37 is fastened, which is connected to a gas hose 38 which runs to a liquid gas container, not shown, with a pressure regulator.

To enable such a burner battery to be guided by a walking person at a constant distance above a work surface, the burner battery 31 is provided with casters 39 of which only one is shown and whose horizontal axes of rotation are perpendicular to the burner axes.

For the concentration of the heat and for the elimination insofar as possible of the disturbing influence of side wind, baffles 40 and 41 are disposed on both sides of the burner battery 31, with their perpendicular principal planes parallel to the burner axes. The bottom edges 42 of the baffles are just above the work surface. As it can be seen in FIG. 4, the baffles are hinged so as to be able to be swung upward and rearward.

I claim:

1. Portable burner (1) comprising: a first injector nozzle (2) for fuel gas, which is disposed adjacent a first primary air aspiration point (4) at an entry end (5) of a first mixer tube (6), a spin producer (10), which is disposed in the first mixer tube at a distance in front of an outlet end (13) thereof forming a second nozzle with a nozzle axis, and a second mixture tube (18) whose internal cross section (F2) is greater than an internal cross section (F1) of the first mixer tube and is disposed concentrically with the outlet end of the first mixer tube directly producing a burner flame, has an entry end (19) for the burner flame and second aspiration points (20) for secondary air in the area of the outlet end (13) of the first mixer tube (6), and extends in the direction of flow all the way to an outlet end (23) of the second mixer tube, characterized in that a) between the outlet end (13) of the first mixer tube (6) and the inlet end (19) of the second mixer tube (18) a filler body (16) at least substantially filling the radial distance between the two tube ends is disposed with an end face (21) which extends substantially radially from the nozzle axis (A—A) and from which the outlet end (13) of the first mixer tube (6) forming the second nozzle protrudes by a given amount s, and that b) the second aspiration points (20) for the secondary air are disposed exclusively in the area of the outlet end (13) of the first mixer tube (6) and are aimed radially at the nozzle axis (A—A) such that the secondary air impinges substantially vertically onto the initial length of the burner flame running in the direction of the nozzle axis, and that the second mixer tube (18) has between the second aspiration points (20) and its outlet end (23) a closed circumferential portion (18*a*) whose length has at least three times the axial length of the second aspiration points (20).

2. Burner according to claim 1, characterized in that the filler body (16) is configured as a rotationally symmetrical piece with an internal bore (15) for the insertion of the first mixer tube and with at least one external surface (17) for the placement of the second mixer tube.

3. Burner according to claim 1, characterized in that the outlet end (13) of the first mixer tube (6), which forms the nozzle, protrudes 4 to 15 mm, out of the end face (21) of the filler body (16).

4. Burner according to claim 1, characterized in that the circular edge (14) of the outlet end (13) of the first mixer tube (6) is rolled inwardly by 15 to 25%, of the inside diameter of the first mixer tube (6).

5. Burner according to claim 1, characterized in that the ratio of the distance (d) from the end face (12) of the spin producer (10) to the edge (14) of the outlet end of the first mixer tube (6) to the inside diameter (D1) of the first mixer tube (6) amounts to at least 1.0.

6. Burner according to claim 1, characterized in that the spin producer (10) has vanes (11) distributed about the axis (A—A) of the first mixer tube (6) whose pitch angle with respect to the axis (A—A) at the outside diameter of the spin producer is smaller than 30 degrees, the pitch angle being selected smaller with increasing burner power at given dimensions.

7. Burner according to claim 1, characterized in that the ratio of the inside cross section (F2) of the second mixer tube (18) to the inside cross section (F1) of the first mixer tube (6) amounts to between 4.0 and 4.8.

8. Burner according to claim 1, characterized in that the second aspiration points (20) are configured as axially parallel slots (24) distributed on the circumference of the second mixer tube (18), whose end sections (24*a*) pointing toward the filler body (16) overlap at least partially the portion of the first mixer tube (6) that protrudes from the end face (21) of the filler body (16).

9. Burner according to claim 8, characterized in that the proportion of the sum of the width of all slots (24), seen int h circumferential direction, to the total circumference of the second mixer tube (18) amounts to at least 50 percent.

10. Burner according to claim 9, characterized in that the ratio of the sum of the cross-sectional areas of all slots (24) to the internal cross section "F2" of the second mixer tube (18) amounts to at least 1.2.

11. Burner according to claim 8, characterized in that the ratio of the length "LS" of each single slot (24) to the length "L" of the second mixer tube (18) that protrudes past the filler body amounts to between 0.10 and 0.20.

12. Burner according to claim 1, characterized in that the spin producer (10) is beveled on its upwind side, the diameter of the smallest circumferential edge of the bevel corresponding substantially to a core diameter which is an outside diameter minus a radial vane length.

13. Burner according to claim 1,2 characterized in that the pitch angle of vanes (11) to an axis (A—A) is substantially of the same magnitude as the angle between the generatrices of the bevel and a plane radial to the asks (A—A).

14. Burner according to claim 1, characterized in that the burner (1, 1*a*) is fastened to a beam (32) with a plurality of similar burners (1*b*, 1*c*, 1*d*, . . . ) with parallel alignment of their axes (A—A) with one another and formation of a burner battery (31) and are connected to a common gas supply line (33).

15. Burner according to claim 14, characterized in that the burner battery (31) is provided with casters (39) whose axes of rotation are perpendicular to the burner axes (A—A).

16. Burner according to claim 14, characterized in that baffles (40, 41) are disposed on both sides of the burner battery (31) and their principal planes are parallel to the burner axes (A—A).

17. Burner according to claim 16, characterized in that the baffles (40, 41) are hinged to the beam (32).

* * * * *